US010041363B2

(12) United States Patent
Humhauser et al.

(10) Patent No.: US 10,041,363 B2
(45) Date of Patent: Aug. 7, 2018

(54) BLADE-DISK ASSEMBLY, METHOD AND TURBOMACHINE

(71) Applicant: MTU Aero Engines AG, Munich (DE)

(72) Inventors: Werner Humhauser, Moosburg (DE); Herman Klingels, Dachau (DE); Alexander Kloetzer, Fuerstenfeldbruck (DE)

(73) Assignee: MTU Aero Engines AG, Munich (DE)

( * ) Notice: Subject to any disclaimer, the term of this patent is extended or adjusted under 35 U.S.C. 154(b) by 330 days.

(21) Appl. No.: 14/546,675

(22) Filed: Nov. 18, 2014

(65) Prior Publication Data

US 2015/0139811 A1 May 21, 2015

(30) Foreign Application Priority Data

Nov. 19, 2013 (DE) ..... 10 2013 223 583

(51) Int. Cl.
*F01D 5/30* (2006.01)
*F01D 5/14* (2006.01)
*F01D 5/32* (2006.01)

(52) U.S. Cl.
CPC ..... *F01D 5/3038* (2013.01); *F01D 5/147* (2013.01); *F01D 5/32* (2013.01); *F05D 2230/60* (2013.01); *Y10T 29/49321* (2015.01)

(58) Field of Classification Search
CPC ..... F01D 5/30; F01D 5/303; F01D 5/3038; F01D 5/32; F01D 5/326
See application file for complete search history.

(56) References Cited

U.S. PATENT DOCUMENTS 3,282,561 A 11/1966 Frankel et al.
3,383,094 A * 5/1968 Diggs ..... F01D 5/30 416/221

(Continued)

FOREIGN PATENT DOCUMENTS

DE 103 50 627 5/2004
DE 10 346 263 4/2005

(Continued)

OTHER PUBLICATIONS

Machine Translation of FR 2971541 [retrieved on Dec. 2, 2016]. Retrieved from: Espacenet.*

*Primary Examiner* — Igor Kershteyn
*Assistant Examiner* — Eric Zamora Alvarez
(74) *Attorney, Agent, or Firm* — Davidson, Davidson & Kappel, LLC

(57) ABSTRACT

A blade-disk assembly of a turbomachine is provided, the blade-disk assembly having a plurality of adjacent rotor blades and a closure blade which are tilted into an anchoring groove, and at least one circumferential retention element which interlockingly cooperates with at least one blade, as well as a plurality of tilt-out prevention elements which are disposed between the groove base and the root portions and which, in the rest state, space the blades from the groove base when in the upper position. The blade-disk assembly further has a locking element, a portion of which is located between the groove base and the root portions and which, in the rest state, spaces the closure blade from the groove base when in the upper position. A method for assembling such a blade-disk assembly, as well as a turbomachine, is also provided.

9 Claims, 6 Drawing Sheets

(56) References Cited

U.S. PATENT DOCUMENTS

| | | | | |
|---|---|---|---|---|
| 3,902,824 | A * | 9/1975 | Sauer | F01D 5/32 416/215 |
| 4,255,086 | A | 3/1981 | Roberts | |
| 4,451,203 | A * | 5/1984 | Langley | F01D 5/32 416/193 A |
| H001258 | H * | 12/1993 | Hindle, Jr. | F01D 5/303 411/393 |
| 6,752,598 | B2 * | 6/2004 | Antunes | F01D 5/32 416/215 |
| 7,708,529 | B2 * | 5/2010 | Klingels | F01D 5/3038 416/220 R |
| 8,206,116 | B2 * | 6/2012 | Pickens | F01D 5/3038 29/889.21 |
| 8,251,667 | B2 * | 8/2012 | Wilson | F01D 5/3038 416/215 |
| 8,770,938 | B2 | 7/2014 | Kreiselmaier et al. | |
| 2001/0055527 | A1 | 12/2001 | Yvon Goga et al. | |
| 2003/0123986 | A1 | 7/2003 | Antunes et al. | |
| 2004/0086387 | A1 | 5/2004 | Fitts et al. | |
| 2006/0083621 | A1 | 4/2006 | Klingels | |
| 2006/0188376 | A1 | 8/2006 | Klingels et al. | |
| 2007/0059181 | A1 | 3/2007 | Klingels et al. | |
| 2011/0116933 | A1 * | 5/2011 | Aiello | F01D 5/32 416/215 |

FOREIGN PATENT DOCUMENTS

| | | | | |
|---|---|---|---|---|
| DE | 60 202 738 | | 3/2006 | |
| DE | 10 2004 051 116 | | 4/2006 | |
| DE | 10 2005 003 511 | | 7/2006 | |
| DE | 60 116 460 | | 9/2006 | |
| EP | 1 801 355 | | 6/2007 | |
| EP | 2320030 | | 5/2011 | |
| FR | 2965008 | | 3/2012 | |
| FR | 2971541 | A1 * | 8/2012 | F01D 5/3038 |
| GB | 630732 | | 10/1949 | |
| JP | H06212905 | | 8/1994 | |

* cited by examiner

BLADE-DISK ASSEMBLY, METHOD AND TURBOMACHINE

This claims the benefit of German Patent Application DE 10 2013 223 583.6, filed Nov. 19, 2013 and hereby incorporated by reference herein.

The present invention relates to a blade-disk assembly, a method for manufacturing such a blade-disk assembly, and to a turbomachine.

BACKGROUND

Known blade-disk assemblies in turbomachines, such as gas turbines, normally have blade retainers which, due to their geometric shape, have the effect of minimizing the service life of the blade-disk assembly or even of the entire rotor. This holds true especially when the securing elements for securing the blades on the disk are exposed to high temperatures or mounted at highly stressed locations. This is because the securing elements often create a high additional load on the blades or disk. A frequent problem with sheet-metal securing means is that these loads are transmitted through edges or points and, therefore, lead to additional stress peaks in the material. When using bent wires for securing purposes, an additional problem is to predict a defined position under load. Unwanted movement or vibration of the wire cannot be ruled out.

An example of a blade-disk assembly is disclosed in DE 10 2005 003 511 A1. The blades are arranged on a radial collar of the disk, with their root portions engaging in a circumferential anchoring groove. Radial retention of the blades is accomplished by interlocking of the blades with the radial collar. Circumferential retention of the blades is accomplished by a retaining ring which is arranged on the radial collar opposite to the blades and in toothed engagement with the blades.

British Patent Specification GB 630732 A describes a blade-disk assembly, where the blades are arranged on both sides of a radially outwardly tapering radial collar. Retention of the blades is accomplished by locking wires which are inserted into receiving or insertion grooves extending the circumferential direction, a portion of the cross-sectional profile of each such locking wire lying in the radial collar and another portion lying in the blade roots. In addition, portions of the blade roots may interlockingly engage in a circumferential anchoring groove of the radial collar.

U.S. Pat. No. 3,282,561 discloses a blade-disk assembly, where the blades interlockingly engage in a circumferential anchoring groove of the disk, and adjacent blades are connected by retaining pins which extend angularly relative to the disk and are inserted into corresponding blade root bores.

German Patent Application DE 10 346 263 A1 describes a blade-disk assembly, where the blades are inserted into a radially outwardly widening circumferential groove and secured on the disk by locking wires positioned in receiving grooves, a portion of the cross-sectional profile of each such locking wire lying in the groove walls and another portion lying in the blade roots.

U.S. Pat. No. 4,255,086 discloses a blade-disk assembly, where the blades are axially inserted into a circumferential anchoring groove through an insertion groove and are then displaced in the circumferential direction. The blades are combined to form blade groups, and when at rest are pressed radially outwardly by a wire element extending over a respective one of the blade groups. The insertion groove is configured as a notch in one of the walls of the anchoring groove. Independently of the wire element, tilting-out of the blades is prevented by interlocking with the groove walls.

German Patent Application DE 10 2004 051 116 A1 describes a blade-disk assembly, where the blades interlockingly engage in a circumferential anchoring groove. Radial retention of the blades is accomplished by interlocking with the anchoring groove. Circumferential retention of the blades is provided by longitudinal pins supported in battlement-like projections of the groove walls. The two walls of the anchoring groove are laterally closed, and thus do not have an insertion groove for insertion of the blades. The blades are inserted by a tilting movement of the blades in the axial direction of the blade-disk assembly.

German Patent Documents DE 60 202 738 T2 and DE 60 116 460 T2 describe blade-disk assemblies, where the blades are inserted into a circumferential anchoring groove and retained radially by an interlock between supporting portions of the groove walls and their blade roots. To allow insertion of the blades, the supporting portions are circumferentially spaced apart by radially open cutouts. Circumferential retention of the blades is accomplished by locking systems formed of a locking member inserted into the anchoring groove and a screw extending radially into the locking body. The locking systems are positioned between two adjacent blades and clamped by the screw between the groove base and portions of the blade platforms, with the screws pressing or bearing against the groove base. A similar blade-disk-assembly is disclosed in EP 1 801 355 A1.

French Patent Application FR 2965008 A1 describes another blade-disk assembly. In this blade-disk assembly, for example for securing the blades by means of screws, a U-shaped insert is plastically deformed between a locking member inserted in an anchoring groove and the groove base.

It is an object of the present invention to provide a blade-disk assembly which includes an alternative blade retention system and is easy to assemble and disassemble. Further objects of the present invention are to provide a method for assembling such a blade-disk assembly, and to provide a turbomachine.

These objects are achieved by a blade-disk assembly having the features of claim 1, a method having the features of claim 12, and a turbomachine having the features of claim 14.

An inventive blade-disk assembly of a turbomachine has a plurality of adjacent rotor blades and a closure blade which are inserted with root portions in a circumferential anchoring groove of a rotor disk and cooperate with supporting portions of a forward wall and an aft wall in radially interlocking relationship therewith. Moreover, the blade-disk assembly according to the present invention has at least one circumferential retention element which interlockingly cooperates with at least one of the blades, as well as a plurality of tilt-out prevention elements which are disposed between the groove base and the root portions and which, in the rest state, space the blades from the groove base when in the upper position.

The term "upper position" means that the blades are located on an upper portion of the blade-disk assembly. When the turbomachine is oriented horizontally, this is the portion above the horizontal plane. When the turbomachine is at rest, raising the blades in the upper position causes their root portions to be positioned close to the supporting portions, thereby preventing tilting-out from the anchoring groove in the rest state. In the lower position; i.e., when positioned in a lower portion of the blade-disk assembly, the blades at rest are automatically brought into contact with the supporting portions by gravity and bear thereagainst, whereby they are protected from tilting out. During operation of the turbomachine, the blades are pressed against the supporting portions by the centrifugal force acting on them, and are thereby also protected from tilting out. During operation, the tilt-out prevention elements and, due to the high centrifugal forces also the circumferential retention elements, do not perform any primary securing function. The securing function is provided solely by the supporting portions of the groove walls. This allows the rotor blades and the closure blade to assume an optimal operation position. Since the blades are tilted into place, the supporting portions can be free of blade-insertion cutouts. Preferably, the blades are tilted into place in the axial direction; i.e., about their transverse axis.

The present invention enables the blades of a blade-disk assembly to be secured axially and circumferentially by interlocking and frictional engagement. Due to the specific structural design, life-minimizing properties of the disk geometry are significantly reduced. At the same time, the specific structural design makes it possible to use low-cost securing elements, some of which may be reused after maintenance. The advantage of the blade-disk assembly of the present invention resides particularly in the omission of life-limiting insertion grooves for the blades and securing elements, and in the use of lightly-loaded securing elements. During operation, the securing elements are in contact over a large area with the adjacent components. Because of this, hardly any loads occur at points or edges, and thus no stress peaks occur in the material. The specific design enables the blades to be mounted and removed, as well as secured and end-secured, in an easy, rapid and reproducible manner, because the securing elements do not need to be plastically deformed, or need to be plastically deformed only slightly.

In one exemplary embodiment, the at least one circumferential retention element is an elongated body whose ends are inserted into two mutually aligned receiving recesses of the walls, the at least one blade having an axial recess for receiving the circumferential retention element. The receiving recesses are easy to form and, when positioned in the supporting portions, avoid weakening of the groove walls. In addition, when the receiving recesses are configured as radially open slots, the at least one circumferential retention element can be inserted in a direction from radially outward to radially inward. They may have such widths or radii that the at least one circumferential retention element is not radially inserted, but may be screwed in. Then, the rotation is preferably in a radial direction.

In an alternative exemplary embodiment, the at least one circumferential retention element is a portion of one wall, and the at least one blade has a corresponding axial setback in the platform to cooperate with the wall portion. Thus, the at least one circumferential retention element is formed as an integral portion of the disk, which further simplifies mounting and reduces the time required therefor by eliminating assembly steps.

The tilt-out prevention elements are preferably formed sheet-metal members supported with their supporting flanges or legs on the groove base. Such sheet-metal members can be produced and adapted in a simple manner and are, in particular, U-shaped or M-shaped metal sections. The shape of the sections is dependent on the blade roots, and in particular on the undersides thereof, by which the blades rest on the sheet-metal members when at rest.

In order to circumferentially retain the tilt-out prevention elements, at least some blades may have an abutment portion with which a respective tilt-out prevention element is in lateral contact.

Preferably, the blade-disk assembly has a locking element, a portion of which is located between the groove base and the root portions and which, in the rest state, spaces the closure blade from the groove base when in the upper position. Thus, the closure blade is retained in the anchoring groove in virtually the same manner as the other blades.

In one exemplary embodiment, the locking element is supported in a bore of the closure blade and enters between two adjacent tilt-out prevention elements. Since the bore is formed in the closure blade, no additional locking members are needed. Preferably, the bore is oriented radially in such a way that it extends with its longitudinal axis past the airfoil. Thus, the locking element is freely accessible.

Preferably, the locking element is a threaded element provided with an anti-rotation feature. The threaded element enables precise adjustment and eliminates the need for, in particular, plastic deformation. In addition, the threaded element allows for non-destructive removal, and is thus reusable. The anti-rotation feature prevents unintentional rotation of the threaded element.

In order to prevent loosening of the screw from the closure blade during operation, even in the improbable case that the anti-rotation feature should fail, the locking element may have a head which is thicker than its shank supported in the bore and which is disposed between two tilt-out prevention elements.

In an alternative exemplary embodiment, the locking element has a main body which is similar to a tilt-out prevention element and has a plastically deformable tab that engages in a cutout of the closure blade. The tab allows for simple and effective locking. The closure blade merely has to be formed with a cutout in its root. There is no need to form a bore, in particular an internally threaded bore, through the closure blade.

The installation of this locking element is facilitated if the main body has a plurality of tool receptacles arranged adjacent one another in the circumferential direction of the blade-disk assembly. This allows the tab of the locking element and the cutout of the closure blade to be accurately aligned with one another.

In a method according to the present invention for assembling a blade-disk assembly according to the present invention, first, a rotor disk having a circumferential anchoring groove is provided, the anchoring groove being bounded by two walls having two supporting portions located opposite each other. Then, the rotor blades are tilted into the anchoring groove, with their root portions entering under the supporting portions, and an initially inserted blade being interlockingly engaged with a circumferential retention element. Subsequently, the rotor blades are raised or spaced from the groove base, either individually or in groups, by sliding tilt-out prevention elements under their root portions. Finally, a closure blade is tilted into the anchoring groove, and preferably a locking element cooperating with the closure blade is activated. The method enables the blades to be mounted and removed, as well as secured and end-secured, in an easy, rapid and reproducible manner.

Preferably, the locking element is a threaded element and is screwed in to a depth such that it is spaced from the groove base when the rotor blades are in contact with the supporting portions. This prevents relative movements between the locking element and the groove base during operation, thereby preventing negative phenomena, such as abrasion of material or fretting between the locking element and the groove base.

A turbomachine according to the present invention, such as a gas turbine and, in particular, an aircraft engine, has at least one blade-disk assembly. The blade-disk assembly may be disposed in the compressor and/or turbine. Such a turbomachine features a heavy-duty rotor.

Other advantageous exemplary embodiments of the present invention are the subject matter of further dependent claims.

BRIEF DESCRIPTION OF THE DRAWINGS

Preferred exemplary embodiments of the present invention are described in more detail below with reference to schematic drawings, in which.

DETAILED DESCRIPTION

Figure 1:
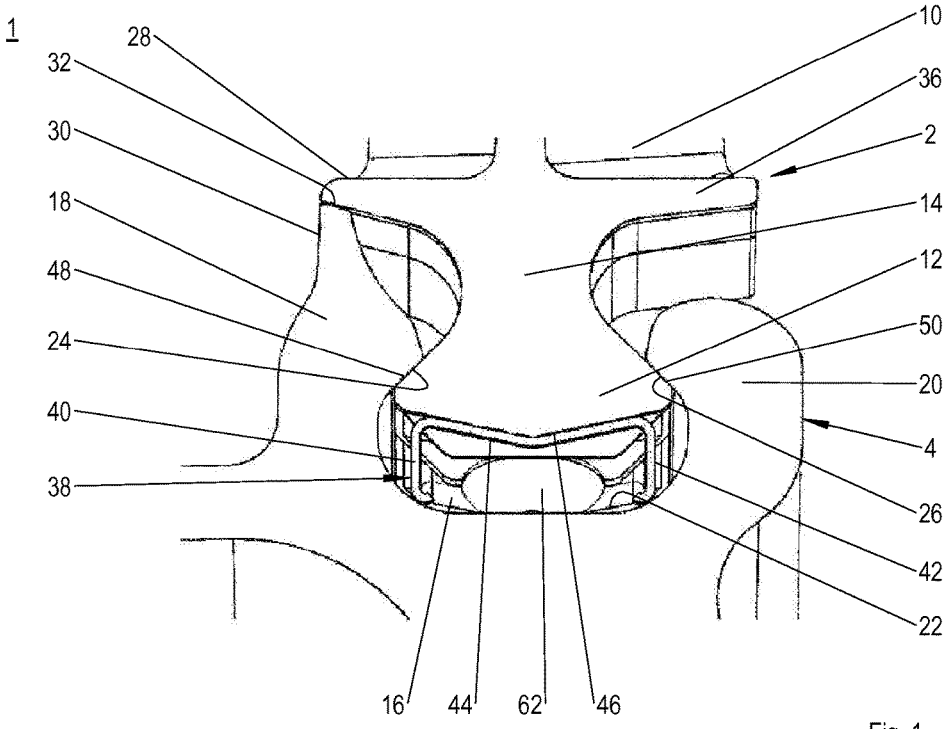
FIG. 1 is a longitudinal sectional view through a first exemplary embodiment of a blade-disk assembly according to the present invention.
Figure 2:
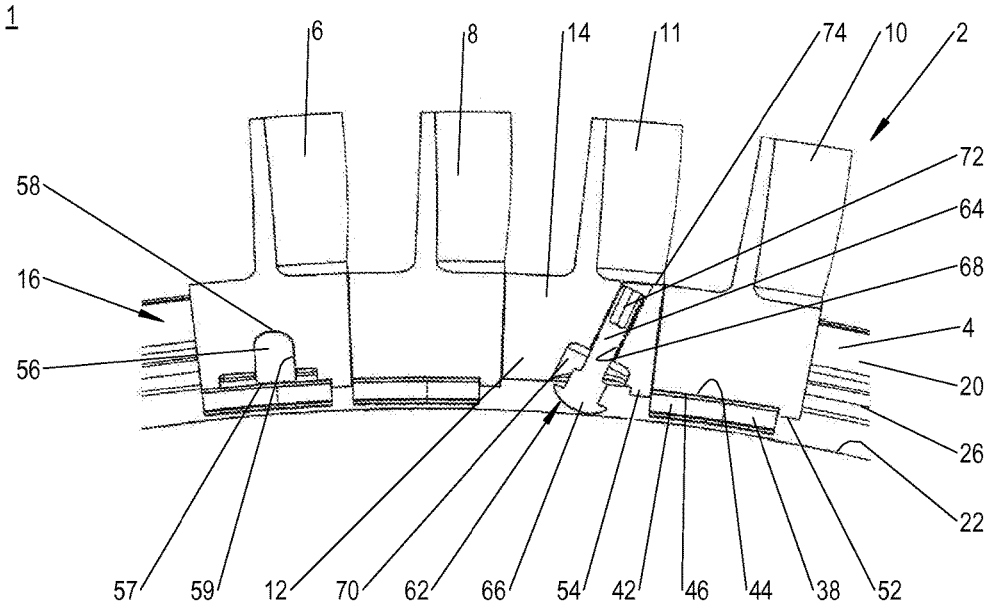
FIG. 2 is a frontal cross-sectional view through the first exemplary embodiment.
Figure 3:
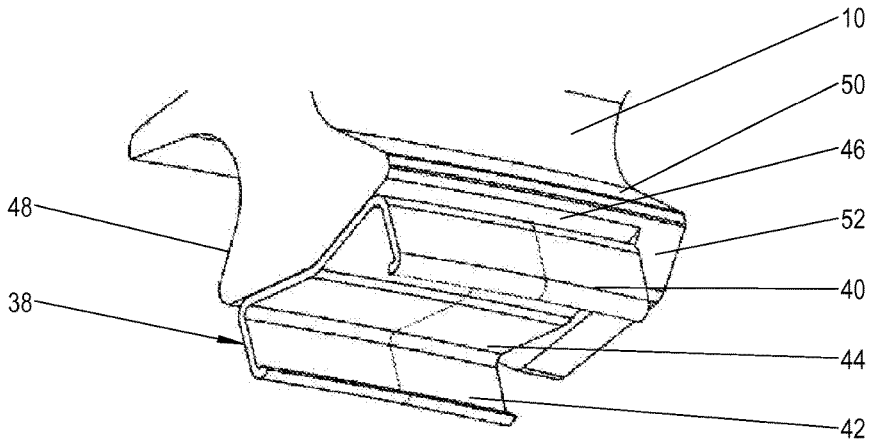
FIG. 3 is a bottom view of a rotor blade and a tilt-out prevention element according to the first exemplary embodiment.

As shown in FIGS. 1 and 2 in longitudinal section, a first exemplary embodiment of an inventive blade-disk assembly of a turbomachine has a row of blades 2 and a rotor disk 4. Referring to FIG. 1, the turbomachine is traversed by a hot gas from left to right in the direction of its longitudinal axis; i.e., in the axial direction. Referring to FIG. 2, the hot gas enters perpendicularly into the plane of the drawing. The turbomachine is, for example, a gas turbine, and especially an aircraft engine.

Blade-disk assembly 1 forms part of a rotor that rotates about the longitudinal machine axis. In the exemplary embodiment shown, the rotor is a turbine rotor, but may also be a compressor rotor. Blade row 2 is composed of a plurality of rotor blades 6, 8, 10, 11 arranged adjacent one another in the circumferential direction of blade-disk assembly 1. Rotor blades 6, 8, 10, 11 are each received with their root or root portion 12 and their neck or neck portion 14 in a circumferential anchoring groove 16 of rotor disk 4.

Anchoring groove 16 has a forward wall 18 and an aft wall 20, as viewed in the direction of flow, the forward and aft walls being connected by a groove base 22. In order to retain rotor blades 6, 8, 10, 11 radially, walls 18, 20 have two annular bulges or supporting portions 24, 26 located opposite each other. During operation of the turbomachine, the roots 12 of rotor blades 6, 8, 10, 11, which are wider than their necks 14, are in radial contact with the supporting portions. In the exemplary embodiment shown, groove base 22 is not inclined with respect to the axial direction.

Rotor blades 6, 8, 10, 11 each extend with a forward platform portion 28 over forward wall 18 and terminate flush with a radially extending end face 30 of forward wall 18. In the rest state, rotor blades 6, 8, 10, 11 each rest with their forward platform portion 28 on a circumferential surface 32 of forward wall 18, and, during operation, are spaced therefrom by a small radial gap. Since forward wall 18 is formed with a uniform height in the circumferential direction, all rotor blades 6, 8, 10, 11 have an identical platform portion 28.

Rotor blades 6, 8, 10, 11 extend with a downstream or aft platform portion 36 over aft wall 20. Because aft wall 20 has a smaller height than forward wall 18, aft platform portions 36 of rotor blades 6, 8, 10, 11 are each radially spaced from aft wall 20 when at rest. In order to prevent rotor blades 6, 8, 10 from inadvertently falling out when at rest in the upper position, tilt-out prevention elements 38 are disposed between groove base 22 and roots 12 of rotor blades 6, 8, 10.

The rotor blade designated by reference numeral 11 is a so-called closure blade, which is inserted last into anchoring groove 16 and which closes the row of blades 2. The closure blade does not cooperate with a tilt-out prevention element 38, but has an alternative tilt-out prevention mechanism, which will be described hereinafter.

In the rest state, rotor blades 6, 8, 10 are spaced by tilt-out prevention elements 38 from groove base 22 in the upper position shown, and are thus raised toward supporting portions 24, 26. Consequently, rotor blades 6, 8, 10 are positioned with their roots 12 located near supporting portions 24, 26 and spaced apart from groove base 22, so that they cannot tilt or be tilted out from anchoring groove 16.

As illustrated in FIG. 1, tilt-out prevention elements 38 have a profile including a forward supporting leg 40, an aft supporting leg 42, and a seat portion 44 extending between supporting legs 40, 42. Tilt-out prevention elements 38 take the form of, for example, multiply bent sheet-metal members and have resilient properties, In the installed state, tilt-out prevention elements 38 are supported with their supporting legs 40, 42 on groove base 22 when in the upper position. Rotor blades 6, 8, 10 rest with the undersides 46 of their roots on seat portions 44, whereby the upper surfaces 48, 50 of their roots are brought nearly into contact with supporting portions 24, 26. When the turbomachine is at rest, rotor blades 6, 8, 10 are able to perform slight radial movements. The shape of seat portions 44 is selected to correspond to the roots' undersides 46. Since the surface segments of seat portion 44 are angled toward each other, tilt-out prevention elements 38 are here in particular in the form of M-shaped sections. If the roots' undersides 46 are, for example, flat, then tilt-out prevention elements 38 are U-shaped in section (see third exemplary embodiment in FIG. 12).

As shown in FIG. 2, each of rotor blades 6, 8, 10 may have one tilt-out prevention element 38 associated therewith.

Alternatively, one tilt-out prevention element 38 is associated with several rotor blades 6, 8, 10. In order to circumferentially retain tilt-out prevention elements 38 in anchoring groove 16, rotor blades 6, 8, 10 and closure blade 11 each have an axially extending abutment portion 52. Abutment portion 52 provides a lateral shoulder surface for tilt-out prevention elements 38, so that in the assembled state, as shown in FIG. 2, tilt-out prevention elements 38 are in contact at both sides with respective adjacent abutment portions 52, 54.

Figure 4:
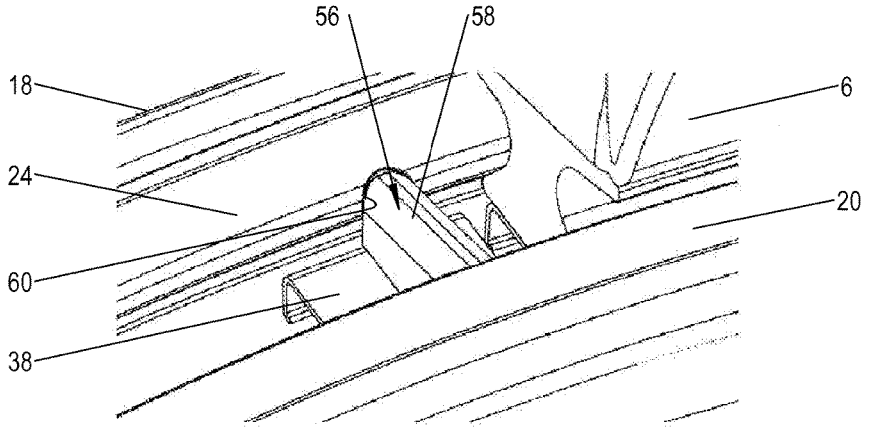
FIG. 4 is a top view of an installed circumferential retention element according to the first exemplary embodiment.
Figure 5:
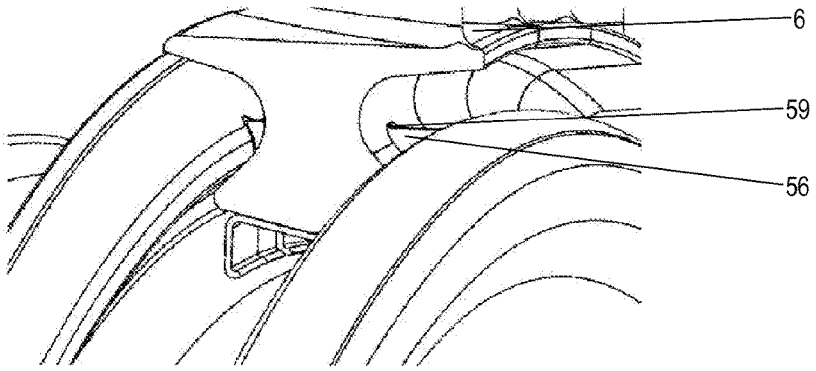
FIG. 5 is a view showing the circumferential retention element in cooperation with a rotor blade.
Figure 6:
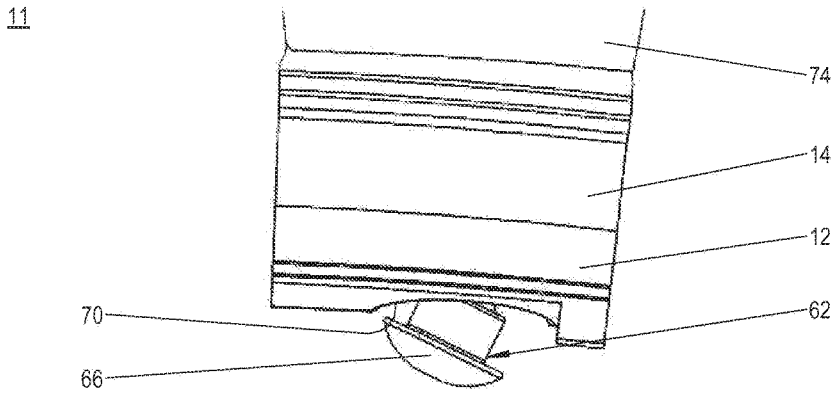
FIG. 6 is a front view of a root portion of a closure blade according to the first exemplary embodiment.
Figure 7:
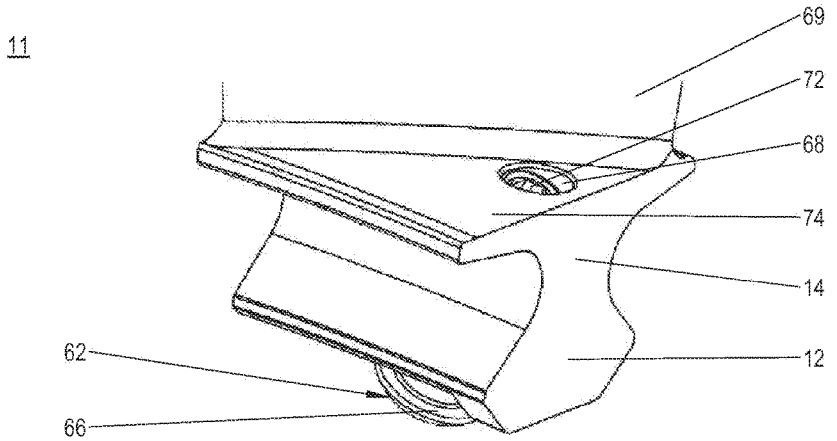
FIG. 7 is a perspective view of the root portion of the closure blade.
Figure 8:
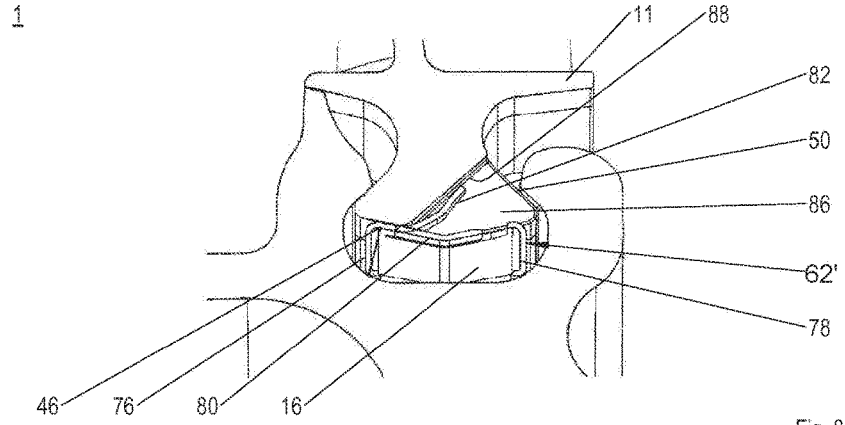
FIG. 8 is a longitudinal sectional view through a second exemplary embodiment of the blade-disk assembly according to the present invention.
Figure 9:
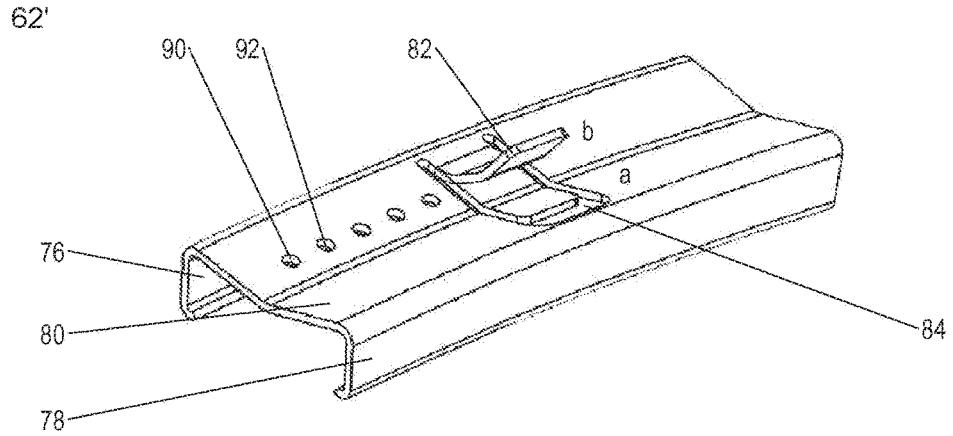
FIG. 9 is an isolated view of a locking element according to the second exemplary embodiment.
Figure 10:
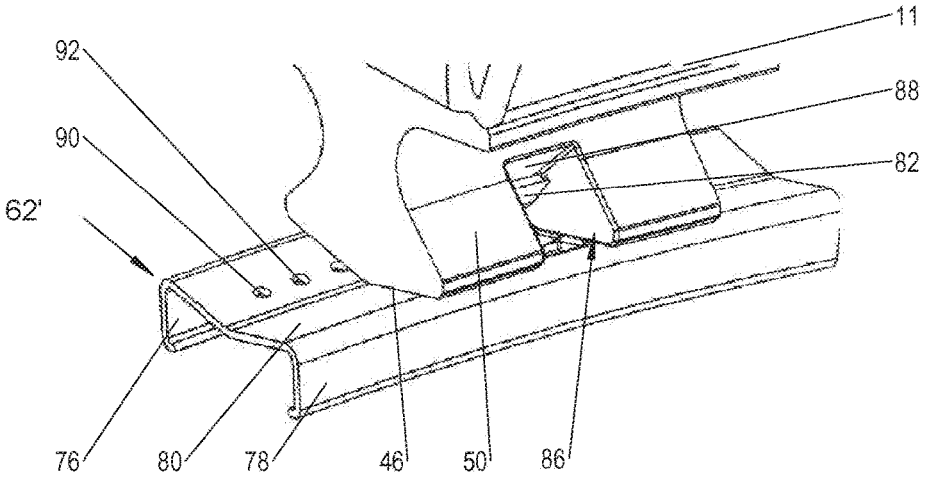
FIG. 10 is a view showing the locking element of the second exemplary embodiment in cooperation with a closure blade.
Figure 11:
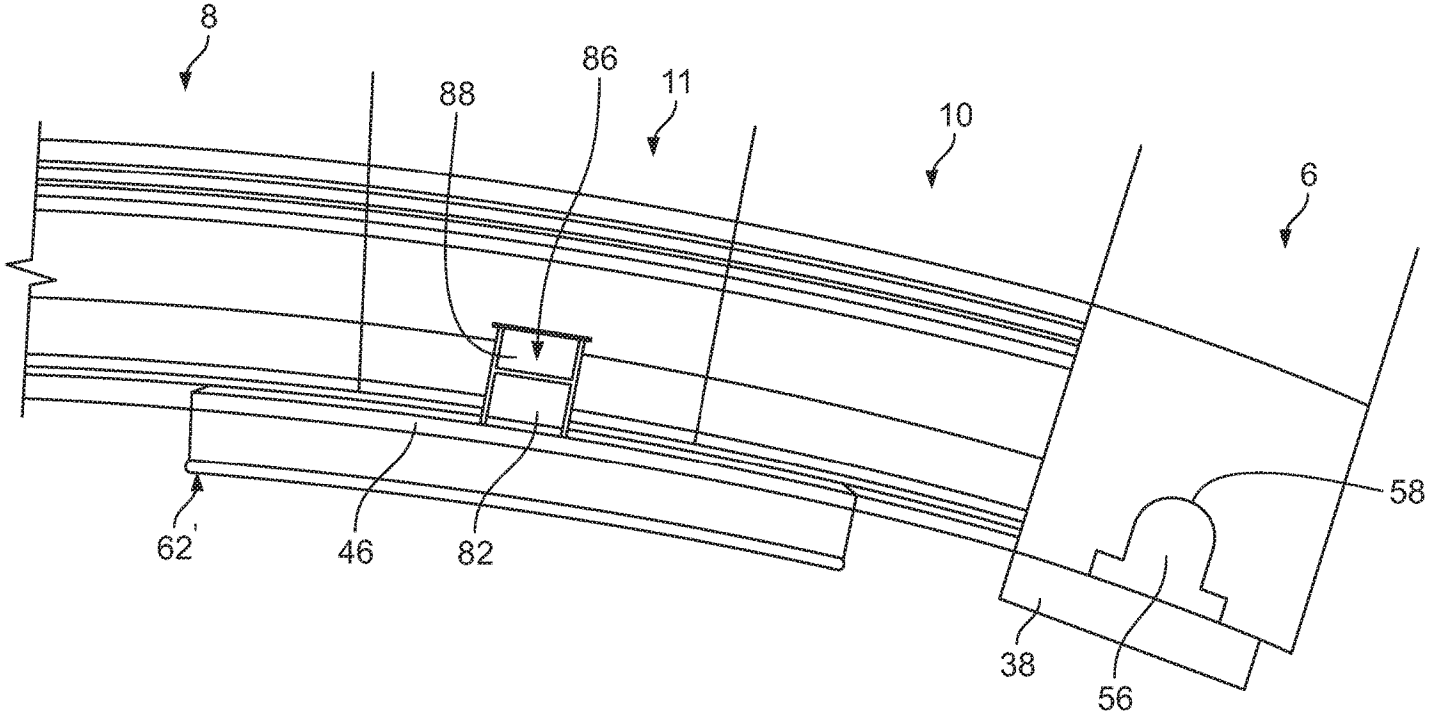
FIG. 11 is a sectional view showing the locking element of the second exemplary embodiment in cooperation with a closure blade, as well as two adjacent rotor blades as seen from the rear.

As shown in FIGS. 2, 4, 5, blade-disk assembly 1 has at least one circumferential retention element 56 for circumferentially retaining rotor blades 6, 8, 10 and closure blade 11. Circumferential retention element 56 is, for example, a rectangular body having a flat lower contact surface 57 and a rounded head surface 58. It forms an interlocking connection with at least one of rotor blades 6, 8, 10 which has a recess 59 extending in the longitudinal direction and having a convex inner surface corresponding to the outer contour of circumferential retention element 56 for receiving the same. It is, of course, also possible to provide several circumferential retention elements 56. For example, each of rotor blades 6, 8, 10 may have one circumferential retention element 56 associated therewith.

Circumferential retention element 56 is inserted at its ends into two mutually aligned receiving recesses 60 in the walls and, in the assembled state, rests with its lower contact surface 57 on a tilt-out prevention element 38. Here, receiving recesses are axial setbacks in the opposing supporting portions 24, 26. Preferably, receiving recesses 60 are formed in the region of supporting portions 24, 26 and extend radially therethrough, so that, on the one hand, walls 18, 20 are not weakened and, on the other hand, circumferential retention element 56 can be inserted in a direction from radially outward to radially inward.

As shown in FIGS. 1, 2, 6 and 7, closure blade 11 cooperates with a locking element 62 to lock blade row 2 in place, the locking element at the same time acting as a tilt-out prevention mechanism, protecting closure blade 11 from tilting out when in the upper position shown. Locking element 62 takes the form of a threaded element having a threaded shank 64 and a head 66 wider than threaded shank 64, and is supported in an internally threaded bore 68 formed in closure blade 11 and extending through the platform, neck 14, and root 12 thereof in a radial direction. In order to prevent closure element 62 from colliding with the closure blade's airfoil 69, internally threaded bore 68 is inclined in a circumferential direction. Head 66 of locking element 62 projects from the root of closure blade 11 and enters between two adjacent tilt-out prevention elements 38. In order to simplify insertion of closure blade 11 into anchoring groove 16, the closure blade has a recess 70 formed in its root to receive head 66, or at least a portion thereof, during insertion. For purposes of operating locking element 62, the locking element has an outer tool receptacle 72 which, in the exemplary embodiment shown, takes the form of a hexagonal socket. In order avoid flow turbulences in the region of locking element 62, locking element 62; i.e., threaded shank 64, is countersunk with respect to a platform upper surface 74 when in the locking position. In order to fix locking element 62 in its locking position, an anti-rotation feature (not shown) is provided which prevents unintentional rotation, and thus displacement, of locking element 62.

To assemble the first exemplary embodiment of the blade-disk assembly, first, the at least one circumferential retention element 56 is radially inserted into receiving recesses 60 and thereby mounted in rotor disk 4. Then, rotor blade 6 is tilted into anchoring groove 16 over circumferential retention element 56. The tilting into place is carried out over aft wall 20 in a forward axial direction. In the process, root 12 of rotor blade 6 is caused to enter under aft supporting portion 26, whereupon the blade is tilted forward, thereby engaging it with the circumferential retention element 56 resting on groove base 22 in such a way that circumferential retention element 56 at least partially enters recess 59. Subsequently, at least one tilt-out prevention element 38 is inserted into anchoring groove 16 and slid circumferentially under circumferential retention element 56, and thus under rotor blade 6. Like rotor blade 6, circumferential retention element 56 now rests on tilt-out prevention element 38 and is spaced from groove base 22. Then, remaining rotor blades 8, 10 are tilted into anchoring groove 16 and spaced from groove base 22 by subsequently inserted tilt-out prevention elements 38. Of course, rotor blades 6, 8, 10 may also be raised in groups; i.e., one tilt-out prevention element 38 may be slid under several rotor blades 6, 8, 10 at the same time. Finally, closure blade 11 is tilted into place with locking element 62 in the retracted position. In the retracted position, head 66 of locking element 62 is at least partially located within recess 70. Locking element 62 is extended to its locking position by rotational movement, thereby causing its head 66 to rest against groove base 22 between the adjacent tilt-out prevention elements 38 and thereby raise closure blade 11. The locking position is reached once closure blade 11 is protected from tilting out when at rest. Preferably, locking element 62 is extended only to such an extent that its head 66 is spaced from groove base 22 during operation. Accordingly, closure blade 11 is not clamped by locking element 62 between groove base 2 and supporting portions 24, 26. In the rest state, slight radial movements are possible. This allows closure blade 11 to assume an optimal operation position and also prevents abrasion of material between head 66 and groove base 22.

FIGS. 8, 9, 10 and 11 show a second exemplary embodiment of the blade-disk assembly 1 according to the present invention. The second exemplary embodiment illustrated in FIGS. 8 through 11 differs from the first exemplary embodiment of FIGS. 1 through 7 essentially in that it has an alternative locking element 62' and an alternative closure blade 11 cooperating with this locking element 62'.

Locking element 62' has a main body which is similar to a tilt-out prevention tilting element. Thus, it has a profile substantially similar to that of the aforedescribed tilt-out prevention elements 38, which are also used in this exemplary embodiment. Locking element 62' is preferably a multiply bent sheet-metal member having resilient properties, which is M-shaped here because the surface segments of the undersides 46 of the root of closure blade 11 and of the roots of the rotor blades 8, 10 adjacent to at least closure blade 11 are, in each instance, angled toward each other. Locking element 62' has a forward supporting leg 76 and an aft supporting leg 78, as well as a seat portion 80 connecting supporting legs 76, 78 and shaped correspondingly to the roots' undersides 46. Locking element 62' has a width or circumferential extent approximately twice the root width of rotor blades 8, 10 and closure blade 11. Rotor blades 8, 10 and closure blade 11 have the same root width. Thus, when in the upper position shown, closure blade 11 is completely raised by locking element 62'. The adjacent rotor blades 8, 10 each rest with one half on locking element 62'.

For purposes of cooperating with closure blade 11, locking element 62' has a centrally disposed tab 82 which is moved from an unlocking position a to a locking position b through plastic deformation. Tab 82 is an integral portion of seat portion 80 and, when in unlocking position a, is disposed within an opening 84. Thus, when in unlocking position a, tab 82 is flush with seat portion 80, which simplifies the mounting of closure blade 11 and adjacent rotor blades 8, 10. In particular, tab 82 is configured to follow the shape of seat portion 80.

In order to receive tab 82, closure blade 11 has a correspondingly shaped locking cutout 86 formed in its root. Locking cutout 86 is formed in root 12 on the aft side thereof at a central position, as viewed in the lateral direction; i.e., in the circumferential direction in the assembled state, and extends through the root's underside 46 and the root's aft upper surface 50. Locking cutout 86 has a locking surface 88 which is inclined with respect to the axial direction and provides a stop for the folded-up tab 82 and, thus, defines locking position b. The width of locking cutout 86 corresponds approximately to width of tab 82; or rather, locking cutout 86 is slightly wider than tab 82 to facilitate assembly.

In order to adjust the position of locking element 62 during assembly, main body 64 has a plurality of tool receptacles 90, 92 formed therein which are arranged adjacent to each other in the circumferential direction. For the sake of clarity, only two tool receptacles are provided with reference numerals 90, 92. Tool receptacles 90, 92 are configured identically and serve for engagement of a suitable tool. They enable locking element 62', when inserted in anchoring groove 16, to be displaced even after rotor blades 8, 10 have been inserted.

The difference from the aforedescribed method for assembling blade-disk assembly 1 resides only in the manner in which closure blade 11 and the rotor blades 8, 10 flanking it are mounted. After previous rotor blades 6 have been inserted together with at least one circumferential retention element 56 and the tilt-out prevention elements 38 supporting them when in the upper position, and once they are in their nominal positions, first, locking element 62' is inserted into anchoring groove 16 and moved laterally. Subsequently, rotor blades 8, 10 and closure blade 11 are tilted in at the free position of anchoring groove 16 by a movement in an aft-to-fore direction and moved to their respective nominal positions. Then, locking element 62' is accurately adjusted in position, and closure blade 11 is titled in. Subsequently, tab 82 is bent from its unlocking position a toward its locking position b until it enters locking cutout 86 and is in contact with locking surface 88. Now, when at rest in the upper position shown, rotor blades 8, 10 and closure blade 11 rest on locking element 62 and are protected from tilting out. In this condition, closure blade 11 rests on locking element 62' over the entire area. Rotor blades 8, 10 each rest with one half on locking element 62'. Thus, rotor blades 8, 10 and closure blade 11 are spaced from groove base 22 and positioned with the upper surfaces 44, 46 of their roots located near supporting portions 24, 26. The engagement of the tab in locking cutout 86 prevents, in particular, tilting-out of closure blade 11.

Figure 12:
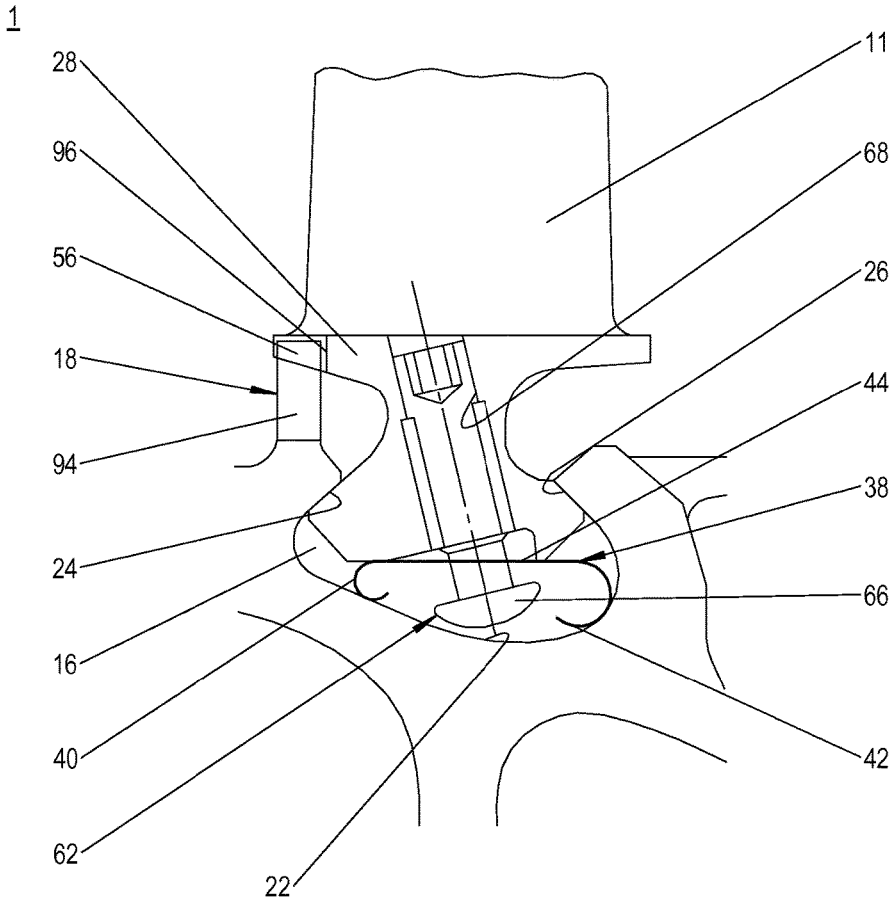
FIG. 12 is a longitudinal sectional view through a third exemplary embodiment of the blade-disk assembly according to the present invention.

FIG. 12 shows a longitudinal sectional view through a third exemplary embodiment of the blade-disk assembly 1 according to the present invention. The third exemplary embodiment illustrated in FIG. 12 differs from the preceding exemplary embodiments essentially in that it has an alternative circumferential retention feature.

A closure blade 11 is configured similarly to the closure blade according to the first exemplary embodiment. Accordingly, closure blade 11 cooperates with a screw-like locking element 62 which is supported in an internally threaded bore 68 and has a head 66 of greater width with which it enters between two tilt-out prevention elements 38 in the assembled state. When at rest in the upper position, head 66 rests on groove base 22 and thereby raises closure blade 11. In the operating state shown here, closure blade 11 is pressed with its root 12 against supporting portions 24, 26, and head 66 of locking element 62 is spaced from groove base 22.

In order to raise the other rotor blades when at rest in the upper position, suitable tilt-out prevention elements 38 are provided which are configured similarly to the tilt-out prevention elements 38 according to the preceding exemplary embodiments. They each have two supporting legs 40, 42 and a seat portion 44 connecting supporting legs 40, 42. The essential difference of the tilt-out prevention elements 38 used here is in that seat portion 44 is flat and aft supporting leg 42 is longer than forward supporting leg 40. Thus, tilt-out prevention elements 38 are U-shaped in section. The greater length of second supporting leg 42 results from the inclination of groove base 22 with respect to the axial direction. As considered in the direction of flow, groove base 22 is inclined in a direction from radially outward to radially inward. The difference in length between supporting legs 40, 42 compensates for this difference in height or radial offset, so that seat portion 44 is not inclined with respect to the axial direction.

According to FIG. 12, the alternative circumferential retention feature is provided in that the forward platform portion 28 of at least one rotor blade, here closure blade 11, is laterally in contact with a circumferential retention element 56 configured as a portion of forward wall 18. Circumferential retention element 56 is provided by a radial cutout 94 in forward wall 18. For engagement on circumferential retention element 56, forward platform portion 28 of closure blade 11 has an axial setback 96 formed in the region of its forward edge, at least in a corner region.

Forward wall 18 may have a plurality of such circumferential retention elements 56, so that forward wall 18 would be configured in a crown-like manner. In such an alternative, the other rotor blades 8, 10, 12 would accordingly have a corresponding forward platform portion 28.

The essential difference from the method of the first exemplary embodiment is that no circumferential retention elements 56 need to be inserted into anchoring groove 16 during assembly, since circumferential retention elements 56 are formed directly on forward wall 20.

Disclosed is a blade-disk assembly of a turbomachine, the blade-disk assembly having a plurality of adjacent rotor blades and a closure blade which are tilted into an anchoring groove, and at least one circumferential retention element which interlockingly cooperates with at least one blade, as well as a plurality of tilt-out prevention elements which are disposed between the groove base and the root portions and which, in the rest state, space the blades from the groove base when in the upper position. The blade-disk assembly further has a locking element, a portion of which is located between the groove base and the root portions and which, in the rest state, spaces the closure blade from the groove base when in the upper position. Also disclosed is a method for assembling such a blade-disk assembly, as well as a turbomachine.

LIST OF REFERENCE NUMERALS

1 blade-disk assembly
2 blade row
4 rotor disk
6 rotor blade
8 rotor blade
10 rotor blade

11 rotor blade/closure blade
12 root/root portion
14 neck/neck portion
16 anchoring groove
18 forward wall
20 aft wall
22 groove base
24 supporting portion
26 supporting portion
28 forward platform portion
30 radially extending end face
32 circumferential surface
36 aft platform portion
38 tilt-out prevention element
40 supporting leg
42 supporting leg
44 seat portion
46 underside of the root
48 forward upper surface of the root
50 aft upper surface of the root
52 axial abutment portion
54 axial abutment portion
56 circumferential retention element
57 lower contact surface
58 head surface
59 axial recess
60 receiving recess
62 locking element
64 threaded shank
66 head
68 internally threaded bore
69 airfoil
70 recess
72 tool receptacle
74 platform upper surface
76 supporting leg
78 supporting leg
80 seat portion
82 tab
84 opening
86 locking cutout
88 locking surface
90 tool receptacle
92 tool receptacle
94 radial cutout
96 axial setback
a unlocking position
b locking position

What is claimed is:

1. A blade-disk assembly of a turbomachine, the blade-disk assembly comprising:

a plurality of adjacent rotor blades and a closure blade inserted with root portions in a circumferential anchoring groove of a rotor disk and cooperating with supporting portions of a forward wall and an aft wall of the circumferential anchoring groove in radially interlocking relationship therewith;

at least one circumferential retention body having surfaces interlockingly cooperating with at least one of the closure blade and the adjacent rotor blades; and a plurality of tilt-out prevention elements disposed between a groove base and the root portions and, in a rest state, spacing the adjacent rotor blades from the groove base when in an upper position, wherein the tilt-out prevention elements are formed sheet-metal members supported, in the rest state, with supporting legs on the groove base; and a locking element which provides locking and tilt-out prevention, the locking element including a threaded shank and a head wider than the threaded shank, the locking element supported in an inclined internally threaded bore formed in the closure blade of the plurality of adjacent rotor blades and extending radially and at an inclined angle in a circumferential direction.

2. The blade-disk assembly as recited in claim 1 wherein the at least one circumferential retention body is an elongated body having ends inserted into two mutually aligned receiving recesses of the forward and aft walls, at least one of the adjacent rotor blades having an axial recess for receiving the circumferential retention element.

3. The blade-disk assembly as recited in claim 1 wherein at least one of the closure blade and the adjacent blades have an abutment portion, a respective tilt-out prevention element being in lateral contact with the abutment portion.

4. The blade-disk assembly as recited in claim 1, wherein a portion of locking element is located between the groove base and the root portions and, in the rest state, spacing the closure blade from the groove base when in the upper position.

5. The blade-disk assembly as recited in claim 4 wherein the locking element is provided between two adjacent tilt-out prevention elements.

6. A turbomachine comprising the blade-disk assembly as recited in claim 1.

7. A blade-disk assembly of a turbomachine, the blade-disk assembly comprising:

a plurality of adjacent rotor blades and a closure blade inserted with root portions in a circumferential anchoring groove of a rotor disk and cooperating with supporting portions of a forward wall and an aft wall of the circumferential anchoring groove in radially interlocking relationship therewith;

at least one circumferential retention element interlockingly cooperating with at least one of the closure blade and the adjacent rotor blades, wherein the at least one circumferential retention element is a wall portion of one of the forward and aft walls, and at least one of the closure blade and the adjacent blades has a corresponding axial setback in a platform to cooperate with the wall portion; and a plurality of tilt-out prevention elements disposed between a groove base and the root portions and, in a rest state, spacing the adjacent rotor blades from the groove base when in an upper position, wherein the tilt-out prevention elements are formed sheet-metal members supported, in the rest state, with supporting legs on the groove base; and a locking element which provides locking and tilt-out prevention, the locking element including a threaded shank and a head wider than the threaded shank, the locking element supported in an inclined internally threaded bore formed in the closure blade of the plurality of adjacent rotor blades and extending radially and at an inclined angle in a circumferential direction.

8. A blade-disk assembly of a turbomachine, the blade-disk assembly comprising:

a plurality of adjacent rotor blades and a closure blade inserted with root portions in a circumferential anchoring groove of a rotor disk and cooperating with supporting portions of a forward wall and an aft wall of the circumferential anchoring groove in radially interlocking relationship therewith;

at least one circumferential retention body having surfaces interlockingly cooperating with at least one of the closure blade and the adjacent rotor blades; and a plurality of tilt-out prevention elements disposed between a groove base and the root portions and, in a rest state, spacing the adjacent rotor blades from the groove base when in an upper position, wherein the tilt-out prevention elements are formed sheet-metal members supported, in the rest state, with supporting legs on the groove base;

a locking element having one or more contact surfaces engaging the closure blade, a portion of locking element being located between the groove base and the root portions and, in the rest state, spacing the closure blade from the groove base when in the upper position;

wherein the locking element has a main body and a plastically deformable tab engaging in a cutout of the closure blade.

9. The blade-disk assembly as recited in claim 8 wherein the main body has a plurality of tool receptacles arranged adjacent one another in a circumferential direction of the blade-disk assembly.

* * * * *